US005346445A

United States Patent [19]

Chang

[11] Patent Number: 5,346,445

[45] Date of Patent: Sep. 13, 1994

[54] ARM LEVER FOR AN EXERCISE BICYCLE

[75] Inventor: Chi-Ming Chang, Taichung Hsien, Taiwan

[73] Assignee: Giant Manufacturing Co., Ltd., Taichung Hsien, Taiwan

[21] Appl. No.: 177,731

[22] Filed: Jan. 5, 1994

[51] Int. Cl.[5] ..... A63B 21/12

[52] U.S. Cl. ..... 482/62; 482/908

[58] Field of Search ..... 482/51, 908, 57, 58, 482/59, 62, 63, 148, 70, 72, 73, 111-112

[56] References Cited

U.S. PATENT DOCUMENTS

| | | | |
|---|---|---|---|
| Re. 34,478 | 12/1993 | Dalebout et al. | 482/62 |
| 4,188,030 | 2/1980 | Hooper | 482/59 |
| 4,880,225 | 11/1989 | Lucas et al. | 482/62 |
| 5,149,312 | 9/1992 | Croft et al. | 482/62 |

*Primary Examiner*—Stephen R. Crow
*Attorney, Agent, or Firm*—Harness, Dickey & Pierce

[57] ABSTRACT

An arm lever for an exercise bicycle has a pivot portion to be mounted pivotally on a front end portion of a bicycle frame and a bottom end to be connected to an end of a crank arm. The bottom end of the arm lever is provided with a locking plate which has a forked extension with a distal bottom end, an upright slit that opens from the distal bottom end, and a plurality of spaced locking holes that extend through the slit. The slit permits the extension of the end of the crank arm therein. The forked extension is connected to the crank arm at a selected one of the locking holes to vary the distance of the end of the crank arm from the pivot portion and vary correspondingly the range of pivoting movement of the arm lever to suit the user's physique.

4 Claims, 7 Drawing Sheets

ARM LEVER FOR AN EXERCISE BICYCLE

BACKGROUND OF THE INVENTION

1. Field of the Invention

The invention relates to an exercise bicycle, more particularly to an improved arm lever construction for an exercise bicycle, 2. Description of the Related Art Referring to FIG. 1, a conventional exercise bicycle 10 is shown to comprise a frame 11, a foot pedal assembly 12, a reciprocating arm assembly 13, a resistance wheel 14, and a transmission system 15.

The transmission system 15 includes a drive shaft 121 mounted rotatably on a rear end portion of the frame 11, and a pair of eccentric arms 122 mounted securely on two ends of the drive shaft 121 (only one eccentric arm 122 is shown). The foot pedal assembly 12 includes a pair of foot pedal cranks 123 mounted on a distal end of a respective one of the eccentric arms 122 (only one foot pedal crank 123 is shown). The reciprocating arm assembly 13 includes a pair of reciprocating arm levers 131 mounted pivotally on a front end portion of the frame 11 on two sides of the latter, and a pair of crank arms 132 (only one of the arm levers 131 and the crank arms 132 is shown). Each of the crank arms 132 has a first end connected to the distal end of a respective one of the eccentric arms 122 and a second end connected pivotally to a lower end of a respective one of the arm levers 131. Thus, operation of the foot pedal cranks 123 results in forward and rearward movement of the crank arms 132 to produce reciprocating movement of the arm levers 131.

The resistance wheel 14 is mounted rotatably on the front end portion of the frame 11 between the arm levers 131. The transmission system 15 is used to link the foot pedal cranks 123 to the resistance wheel 14, thus permitting the rotation of the resistance wheel 14 when the foot pedal cranks 123 are operated. When the arm levers 131 are oscillated, the crank arms 132 cause the drive shaft 121 to rotate, thereby similarly driving the transmission system 15 to rotate the resistance wheel 14. The conventional exercise bicycle can thus be used to exercise the upper and lower parts of the body. Referring to FIG. 2, the range of pivoting movement of the arm levers 131 is fixed and cannot be varied so as to suit the physique of the user. For example, if the user has long hands, it is quite possible that the hands of the user are not fully stretched when the arm levers 131 reach the front limit of the pivoting range. This often results in fatigue, poor exercise results and can affect the user's interest in using the conventional exercise bicycle 10. If the user has short hands, it is possible that the user has to lean forward in order to move the arm levers 131 to the front limit of the pivoting range. This can also cause the user to tire easily.

SUMMARY OF THE INVENTION

Therefore, the objective of the present invention is to provide an improved arm lever construction for an exercise bicycle which can permit adjustments in the range of pivoting movement of the same so as to suit the physique of a user.

Accordingly, the arm lever of the present invention is to be used in an exercise bicycle which includes a frame, a drive shaft mounted rotatably on a rear end portion of the frame, and a crank arm with a first end connected eccentrically to one end of the drive shaft and a second end. The arm lever has a top end, a bottom end and an intermediate pivot portion between the top and bottom ends. The pivot portion is to be mounted pivotally on a front end portion of the frame. The bottom end of the arm lever is to be connected to the second end of the crank arm and is provided with a locking plate. The locking plate has a forked extension with a distal bottom end and an upright slit which opens from the distal bottom end. The forked extension is further formed with a plurality of spaced locking holes which extend through the slit and which are arranged along a curved line. The slit permits the extension of the second end of the crank arm therein. The forked extension is connected to the second end of the crank arm at a selected one of the locking holes to vary the distance of the second end of the crank arm from the pivot portion and vary correspondingly the range of pivoting movement of the arm lever.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
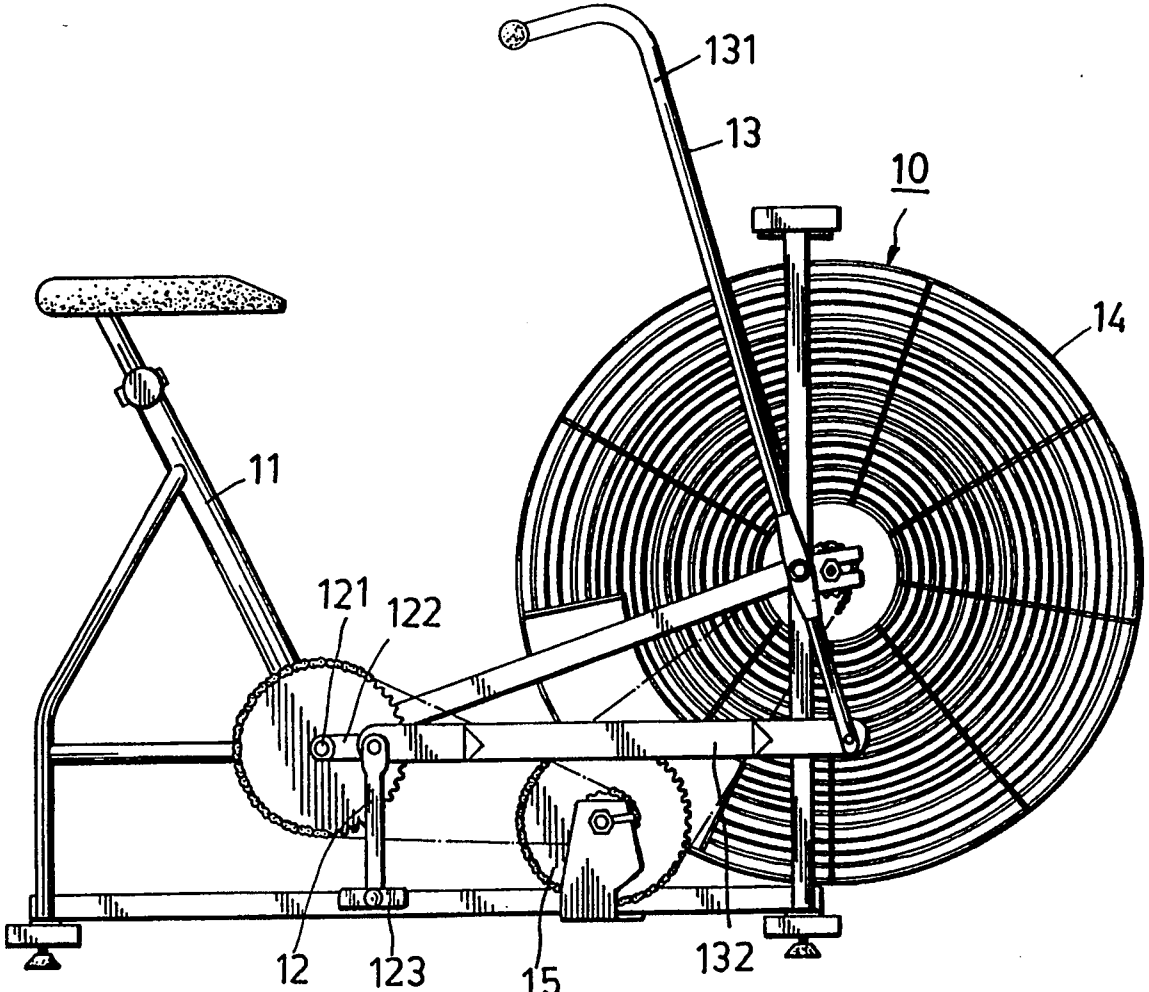
FIG. 1 PRIOR ART
FIG. 1 is a side view of a conventional exercise bicycle.
Figure 2:
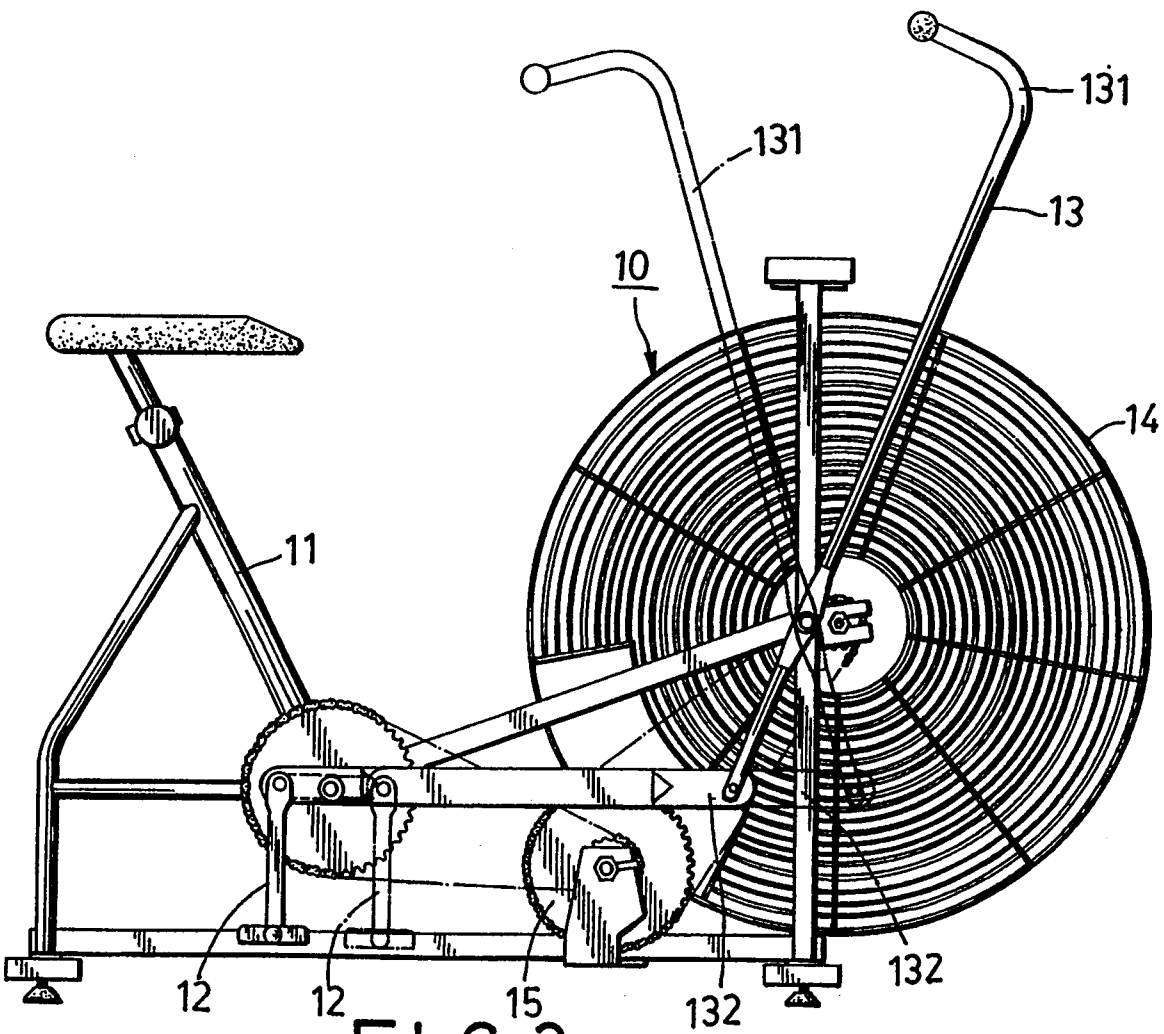
FIG. 2 PRIOR ART
FIG. 2 illustrates the conventional exercise bicycle when arm levers of the same are operated.
Figure 3:
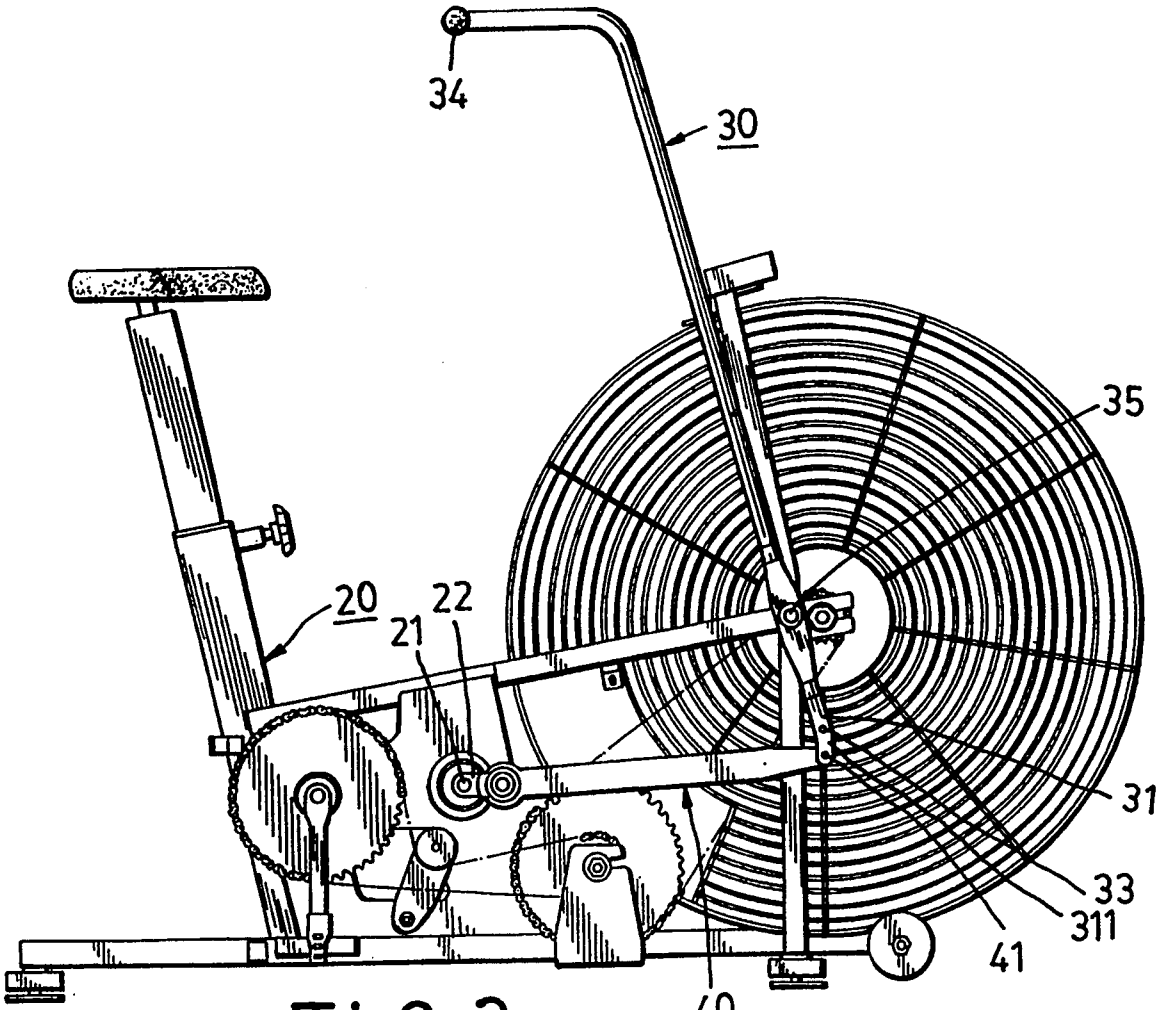
FIG. 3 is a side view of an exercise bicycle which incorporates an arm lever according to a first preferred embodiment of the present invention.

FIG. 3 illustrates an exercise bicycle which incorporates a pair of arm levers 30 (only one arm lever 30 is shown) according to a first preferred embodiment of the present invention. The exercise bicycle comprises a frame 20 and a reciprocating arm assembly, which includes the arm levers 30 and a pair of crank arms 40, mounted on the frame 20. A drive shaft 21 is mounted rotatably on a rear end portion of the frame 20, and a pair of eccentric arms 22 are mounted securely on two ends of the drive shaft 21 (only one eccentric arm 22 is shown). Each of the crank arms 40 has a first end connected to a distal end of a respective one of the eccentric arms 22 and a second end connected to a bottom end of a respective one of the arm levers 30. The arm levers 30 are disposed on two sides of a front end portion of the frame 20.

Figure 4:
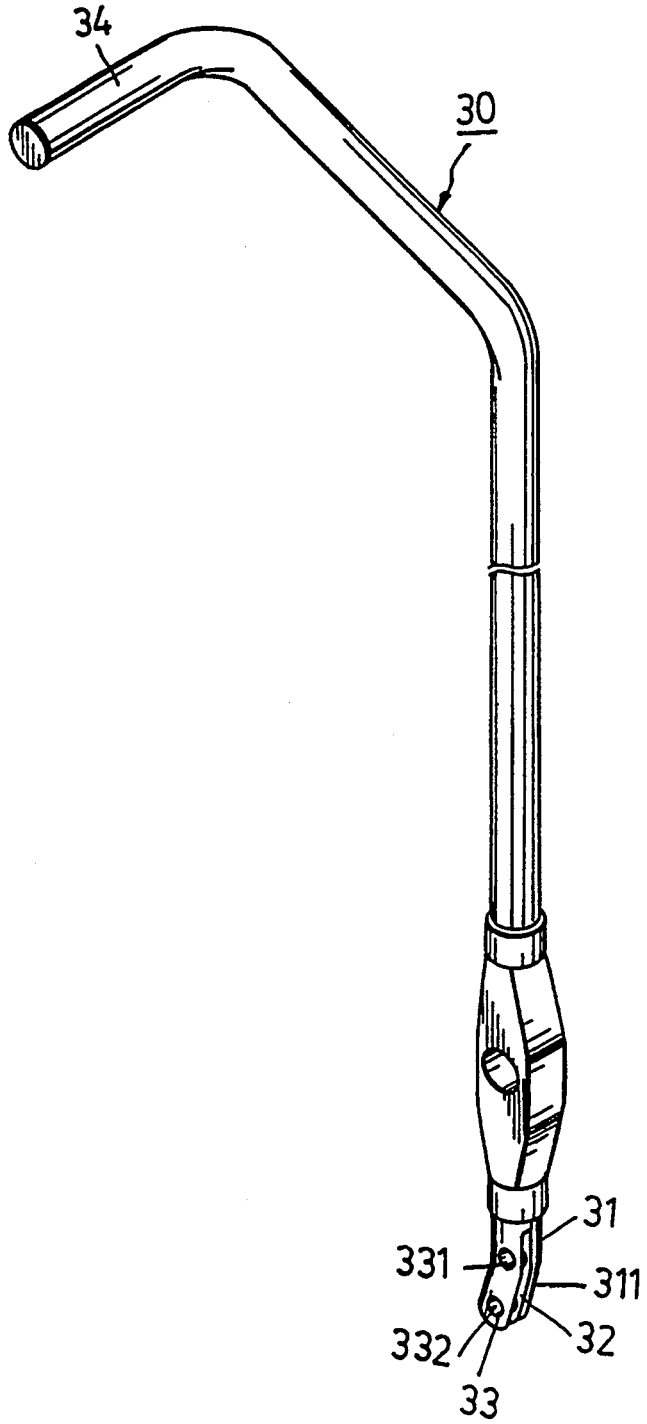
FIG. 4 is a perspective view of the first preferred embodiment.

Referring to FIG. 4, the bottom end of the arm lever 30 is provided with a locking plate 31. In this embodiment, the locking plate 31 has a forked extension 311 which curves rearwardly. The forked extension 311 has an upright slit 32 which opens from a distal bottom end thereof. The forked extension 311 is further formed with a plurality of spaced locking holes 33 which extend through the slit 32 and which are disposed along a curved line. In this embodiment, there are two locking holes 331, 332. The arm lever 30 further has a top end which is formed with a hand grip portion 34.

Referring once more to FIG. 3, the second end of each crank arm 40 extends into the slit 32 of the forked extension 311 of the respective arm lever 30. A locking pin 41 is inserted into a selected one of the locking holes 331, 332 so as to connect pivotally the crank arm 40 to the respective arm lever 30.

Figure 5:
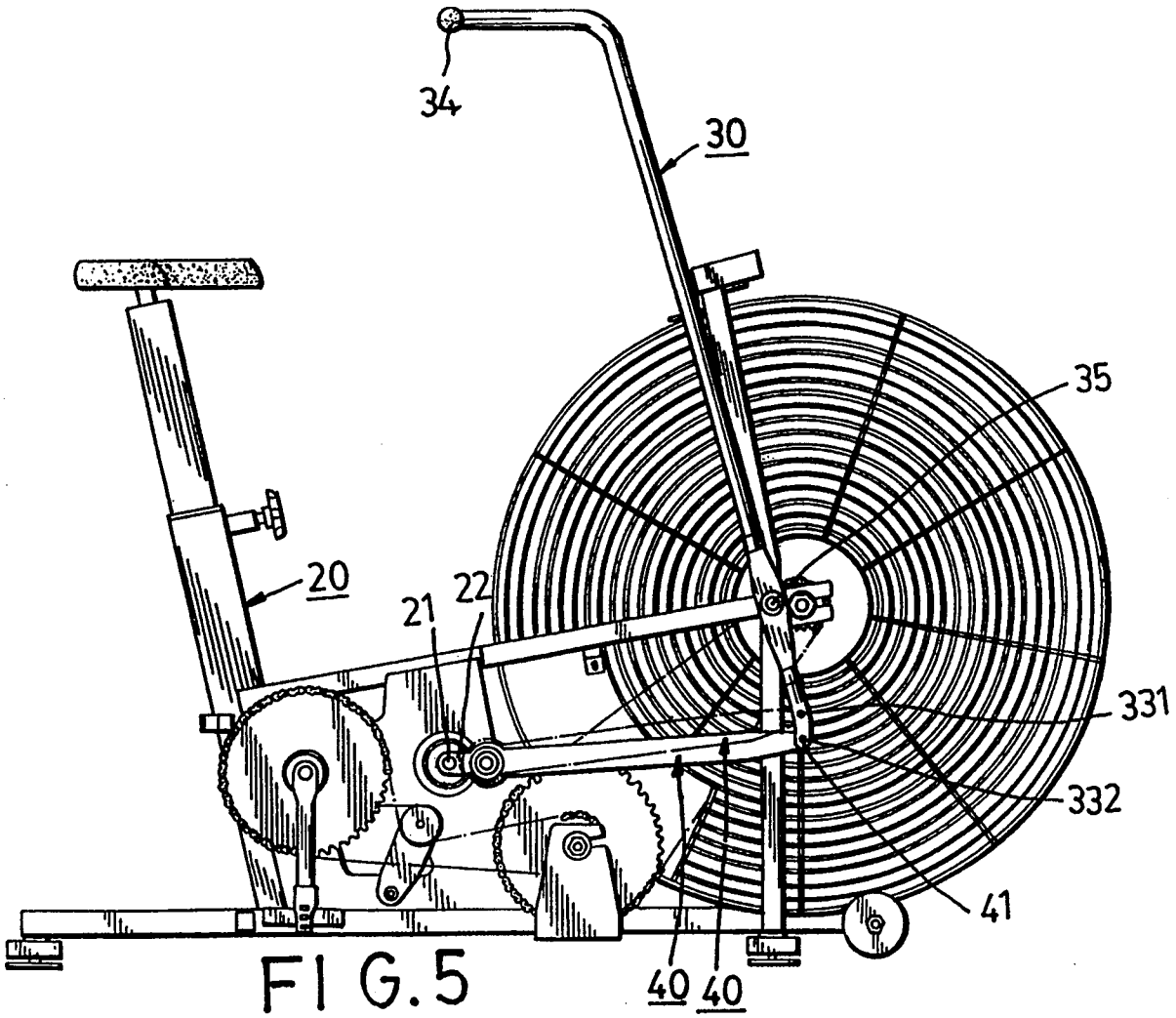
FIG. 5 illustrates how the range of pivoting movement of the arm lever of the first preferred embodiment is adjusted.

The phantom lines of FIG. 5 illustrate one of the crank arms 40 when connected to the respective arm lever 30 at the upper locking hole 331. When it is desired to connect the crank arm 40 to the respective arm lever 30 at the lower locking hole 332, it is preferable to pivot the arm lever 30 to the rear limit of the pivoting range before removing the locking pin 41. The crank arm 40 is movable within the slit 32 when the respective locking pin 41 is removed. At this stage, since the locking holes 331, 332 lie along the path of movement of the second end of the crank arm 40, the crank arm 40 can be easily connected to the arm lever 30 at the lower locking hole 332.

Each arm lever 30 has an intermediate pivot portion 35 disposed between the hand grip portion 34 and the locking plate 31 for mounting pivotally the arm lever 30 on the front end portion of the frame 20. When the arm lever 30 is oscillated, forward and rearward movement of the respective crank arm 40 occurs so as to cause rotation of the drive shaft 21. Since linear movement of the crank arm 40 is limited by the displacement of the first end of the crank arm 40 from the drive shaft 21, the range of pivoting movement of the hand grip portion 34 of the arm lever 30 is also affected thereby.

Figure 6:
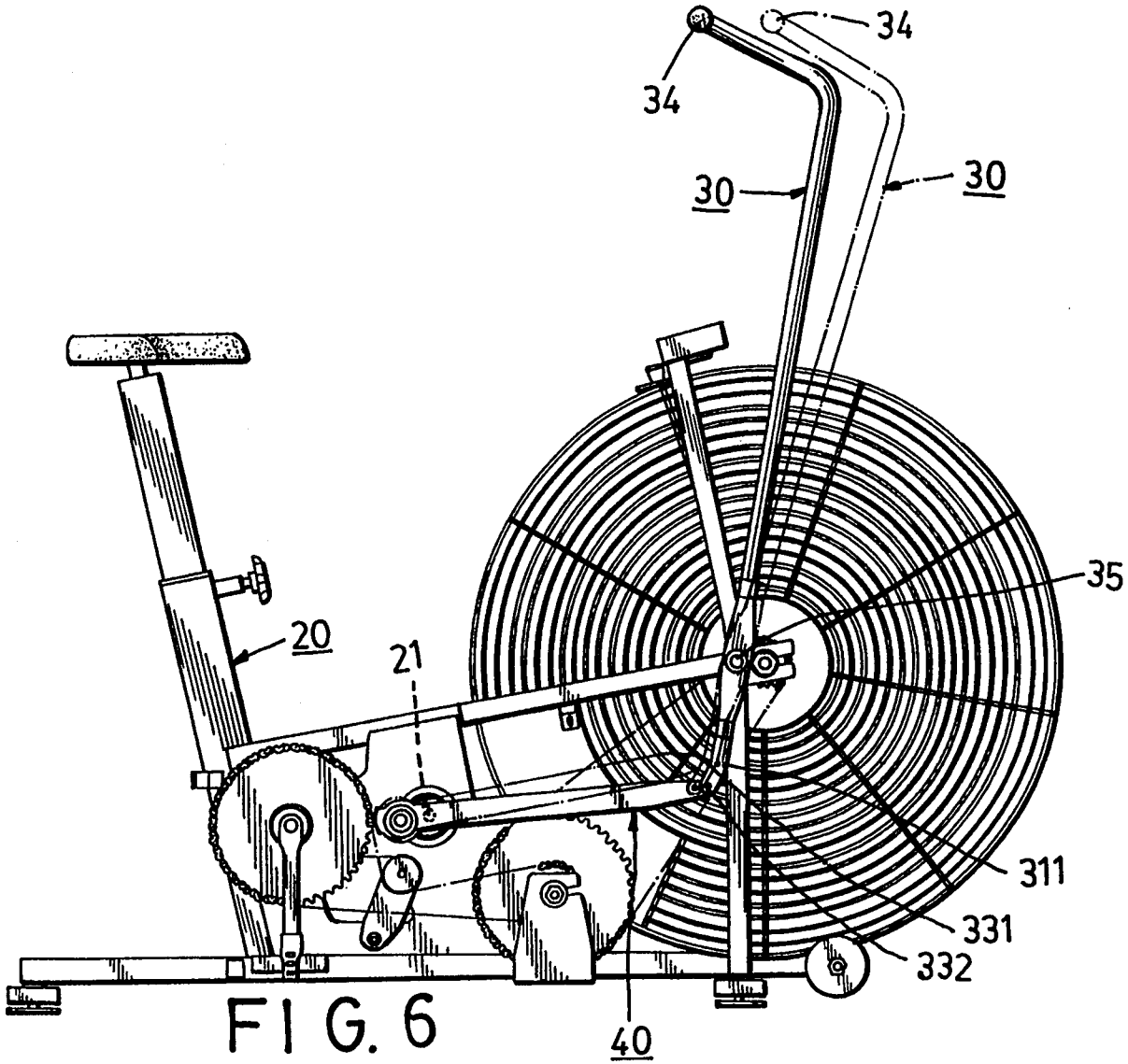
FIG. 6 illustrates the difference in the range of pivoting movement of the arm lever of the first preferred embodiment when the latter is adjusted.

Referring to FIG. 6, when the second end of the crank arm 40 is connected to the lower locking hole 332, a smaller range of pivoting movement by the arm lever 30 is permitted because the second end of the crank arm 40 is disposed farther from the pivot portion 35. Whereas, when the second end of the crank arm 40 is connected to the upper locking hole 331, a larger range of pivoting movement by the arm lever 30 is permitted because the second end of the crank arm 30 is disposed closer to the pivot portion 35 (as shown by the phantom lines).

Before using an exercise bicycle which incorporates the arm lever 30 of the present invention, it is necessary to adjust the connection between the arm levers 30 and the crank arms 40 in order to suit the length of one's arms. If the user's arms are short, the crank arms 40 are connected to the arm levers 30 at the lower locking hole 332 in order to reduce the range of pivoting movement by the arm levers 30, thereby obviating the need for the user to lean forward when moving the arm levers 30 to the front limit of the pivoting range. If the user's arms are long, the crank arms 40 are connected to the arm levers 30 at the upper locking hole 331 in order to increase the range of pivoting movement by the arm levers 30, thereby ensuring that the arms of the user can be stretched fully when the arm levers 30 are oscillated.

Figure 7:
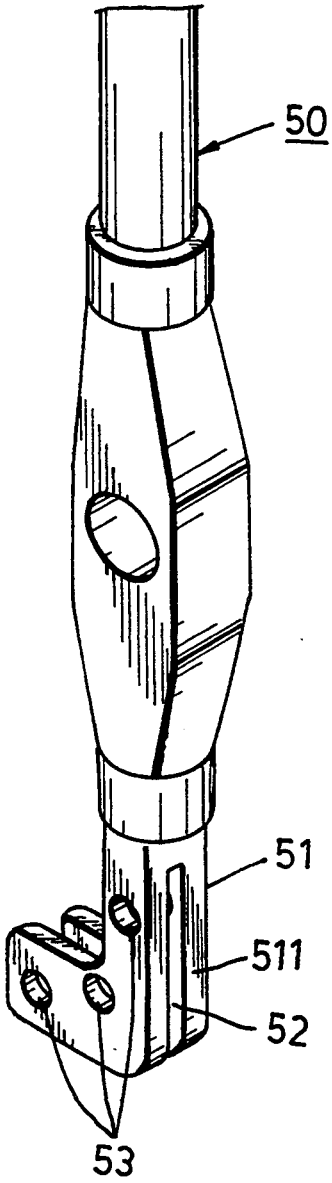
FIG. 7 is a perspective view of the second preferred embodiment of an arm lever in accordance with the present invention.

FIG. 7 illustrates the second preferred embodiment of an arm lever 50 for an exercise bicycle in accordance with the present invention. The arm lever 50 also has a bottom end which is provided with a locking plate 51. In this embodiment, the locking plate 51 has a forked extension 511 which is L-shaped in cross-section and which has an upright slit 52 that opens from a distal bottom end thereof. The forked extension 511 is further formed with three spaced locking holes 53 which extend through the slit 52 and which are arranged along a curved line. As with the previous embodiment, one end of a crank arm (not shown) extends into the slit 52 of the forked extension 511 and can be connected pivotally to the arm lever 50 at a selected one of the locking holes 53.

It has thus been shown that the shape of the forked extension is unimportant, as long as a plurality of locking holes may be formed therethrough in a curved line arrangement.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. An arm lever for an exercise bicycle which includes a frame, a drive shaft mounted rotatably on a rear end portion of the frame, and a crank arm with a first end connected eccentrically to one end of the drive shaft and a second end, said arm lever having a top end, a bottom end and an intermediate pivot portion between said top and bottom ends, said pivot portion being adapted to be mounted pivotally on a front end portion of the frame, said bottom end being adapted to be connected to the second end of the crank arm, wherein the improvement comprises:

said bottom end of said arm lever being provided with a locking plate, said locking plate having a forked extension with a distal bottom end and an upright slit which opens from said distal bottom end, said forked extension being further formed with a plurality of spaced locking holes which extend through said slit, said slit being adapted to permit extension of the second end of the crank arm therein, said forked extension being adapted to be connected to the second end of the crank arm at a selected one of said locking holes to vary distance of the second end of the crank arm from said pivot portion and vary correspondingly range of pivoting movement of said arm lever.

2. The arm lever as claimed in claim 1, wherein said locking holes are arranged along a curved line.

3. An exercise bicycle including a frame, a drive shaft mounted rotatably on a rear end portion of said frame, a crank arm with a first end connected eccentrically to one end of said drive shaft and a second end, and an arm lever having a top end, a bottom end and an intermediate pivot portion between said top and bottom ends, said pivot portion being mounted pivotally on a front end portion of said frame, said bottom end being connected to said second end of said crank arm, wherein the improvement comprises:

said bottom end of said arm lever being provided with a locking plate, said locking plate having a forked extension with a distal bottom end and an upright slit which opens from said distal bottom end, said forked extension being further formed with a plurality of spaced locking holes which extend through said slit, said second end of said crank arm extending into said forked extension and being connected to said forked extension at a selected one of said locking holes to vary distance of said second end of said crank arm from said pivot portion and vary correspondingly range of pivoting movement of said arm lever.

4. The exercise bicycle as claimed in claim 3, wherein said locking holes are arranged along a curved line.

* * * * *